US005193530A

United States Patent [19]

Gamow et al.

[11] Patent Number: 5,193,530

[45] Date of Patent: Mar. 16, 1993

[54] UNDERWATER BREATHING APPARATUS

[75] Inventors: Rustem I. Gamow, Boulder, Colo.; John L. Stevens, Sacramento, Calif.; Malcolm B. Obstfeld, Fort Collins, Colo.

[73] Assignee: Undersea Technology, Inc., Fort Collins, Colo.

[21] Appl. No.: 624,141

[22] Filed: Dec. 7, 1990

Related U.S. Application Data

[63] Continuation-in-part of Ser. No. 452,129, Dec. 15, 1989, abandoned.

[51] Int. Cl.[5] ..... B63C 11/02

[52] U.S. Cl. ..... 128/201.27; 128/201.28

[58] Field of Search ..... 128/201.11, 201.27, 128/201.28

[56] References Cited

U.S. PATENT DOCUMENTS

| | | | |
|---|---|---|---|
| 813,431 | 2/1906 | Iwanami | 128/201.27 |
| 829,274 | 8/1906 | Knoff | 128/201.27 |
| 835,950 | 11/1906 | Iwanami | 128/201.11 |
| 1,000,721 | 8/1911 | Cypra | 128/201.27 |
| 3,050,055 | 8/1962 | Vautin | 128/201.11 |
| 3,467,091 | 9/1969 | Aragona | 128/201.11 |
| 3,525,335 | 8/1970 | Freeman | 128/205.24 |
| 4,362,154 | 12/1982 | Le Masson | 128/201.27 |
| 4,583,536 | 4/1986 | Howell | 128/201.11 |
| 4,674,493 | 6/1987 | Mitchell | 128/202.14 |
| 4,832,013 | 5/1989 | Hartdorn | 128/201.27 |

FOREIGN PATENT DOCUMENTS

| | | |
|---|---|---|
| 443802 | 10/1912 | France . |
| 2119265 | 8/1972 | France . |
| 2593136 | 7/1987 | France . |
| 19080 | 8/1915 | United Kingdom . |
| 436546 | 10/1935 | United Kingdom . |

*Primary Examiner*—Edgar S. Burr
*Assistant Examiner*—Aaron J. Lewis
*Attorney, Agent, or Firm*—Greenlee and Winner

[57] ABSTRACT

An underwater breathing apparatus is provided for delivering air to a submerged diver. A manual pump supplies air under pressure to a reservoir bag for delivery to a diver through an air hose. Alternatively, the reservoir bag can be further connected by an air hose to a floatable variable-pressure reservoir bag that delivers air through an air hose to a submerged diver. In order to constantly maintain the air pressure in the reservoir bag in a preselected range, a pressure gauge is provided for the pump operator, who then pumps selectively to maintain the proper air pressure. The diver wears a breathing means having a flow restrictor/shut-off valve, a one-way inlet valve, and a one-way exhaust valve for exhalation. Additionally, an electric pump may be used either to replace the manual pump or as a back-up thereto.

20 Claims, 3 Drawing Sheets

UNDERWATER BREATHING APPARATUS

This application is a continuation-in-part of U.S. patent application No. 07/452,129 filed Dec. 15, 1989 now abandoned.

TECHNICAL FIELD

This invention relates to an underwater breathing apparatus, and more particularly, to an underwater breathing apparatus utilizing a manual pump to supply low pressure air to an air reservoir for breathing through an air hose by a submerged diver. Alternatively, the air reservoir can be further connected by an air hose to a variable-pressure reservoir that delivers air through an air hose to a submerged diver. The apparatus is especially suitable for pool maintenance, shallow depth boat maintenance, salvage and recreational uses.

BACKGROUND ART

A number of apparatuses for underwater breathing are known in the prior art. One of the most familiar is the system commonly known as scuba, comprising a high pressure tank worn by the diver who breathes through a mouthpiece having a regulator for reducing the air pressure to a breathable level. This apparatus works very well for its intended purpose, but requires special training in order for a diver to become competent in its use. In addition, the high pressure needed for the tanks presents an added risk, and also requires special equipment to refill the tanks. Further, the high pressure air necessitates the use of a complicated and often expensive regulator to reduce the pressure to a breathable level for the diver. Basic scuba apparatus is described in U.S. Pat. No. 829,274 to Knoff.

Another familiar apparatus for use in underwater breathing by a diver is the widely used snorkel. This apparatus also works very well for its intended purpose, but allows only a very shallow operation without some type of pump to force air to the diver. Variations of the snorkel may be seen in U.S. Pat. No. 835,950 to Iwanami; U.S. Pat. No. 4,583,536 to Jan; and U.S. Pat. No. 3,525,335 to Freeman.

A third type of underwater breathing apparatus comprises a pump situated on the surface of the water and delivering air through an air line to a submerged diver. Apparatuses of this type are particularly useful for diving for extended periods of time. However, devices utilizing this principle require constant pumping to avoid air being delivered to a diver in pulses. For this reason, a heavy duty electric or gas-powered pump is typically used in this type of system. In addition, regulators are typically necessary to control the air pressure delivered for breathing by the diver. Examples of this type of invention may be seen in U.S. Pat. No. 813,431 to Iwanami and Woodward; U.S. Pat. No. 3,467,091 to Aragoma; and U.S. Pat. No. 4,674,493 to Mitchell.

In addition to underwater breathing apparatuses, a number of apparatuses used for breathing in irrespirable environments are known. For example, the apparatus disclosed by Great Britain Patent No. 19,080 consists of a manual pump, a breathing bag, and a helmet or mask all connected by flexible tube. Air is delivered to the breathing bag by the manual pump and is then forced to the helmet or mask for respiration by the individual. Although the pressure at which air is forced to the mask is not disclosed, it is unlikely that it is above atmospheric pressure. Great Britain Patent No. 436,546, discloses an apparatus and method for providing breathable air to individuals at high altitudes, especially for use in an airplane. The air supply is compressed to a pressure corresponding to air at ground level and may be supplied to an intermediate rigid container or reservoir, in which air may be stored at an elevated pressure. The air is then supplied to an individual wearing a helmet via a flexible tube or to a chamber in which the individual resides. The pressure at which the air is delivered to the helmet or chamber is kept substantially the same (i.e., ground level pressure) at all altitudes. Neither of the Great Britain patents addresses the unique problems involved in supplying air to underwater divers.

DISCLOSURE OF THE INVENTION

In accordance with the present invention, an underwater breathing device is provided which includes a reservoir bag for receiving air under pressure from a manual pump. For best results an inflatable polyurethane bag acts as the reservoir and a bellows-type foot pump supplies the air pressure. Air from the pressurized reservoir bag (hereinafter referred to as reservoir bag) travels through an air line to an underwater diver. The air is delivered into a breathing means, such as a mouthpiece apparatus or a full face mask. A conventional face mask (i.e., one that covers the eyes and nose) is worn by the diver when the mouthpiece apparatus is used. Two or more outlets and associated diver lines may be provided depending upon the anticipated number of divers to be using the apparatus. In an alternative embodiment, the reservoir bag is connected by an air hose to a floatable variable-pressure reservoir (hereinafter referred to as intermediate bag). For best results, the intermediate bag is also made of an inflatable polyurethane. Air from the intermediate bag then travels through an air hose to the breathing means of the underwater diver(s). When the intermediate bag is used, the outlets and diver lines are provided from the intermediate bag.

Regardless of whether the reservoir bag is used alone or in conjunction with the intermediate bag, it is preferable that air pressure in the reservoir bag is maintained within a selected range which depends upon the depth at which the divers will be operating. For this purpose, a pressure gauge is provided to indicate the reservoir air pressure to the pump operator, who in turn pumps accordingly to maintain the reservoir pressure within the selected range.

In one alternate embodiment, an electric pump is also used to provide pressurized air to the reservoir bag. A three-way master switch is provided which allows the electric pump to be operated either automatically, or locked into an "on" position or an "off" position. In the "on" position, the electric pump operates continuously; and in the "off" position, the manual pump operates exclusively. When the electric pump is in the automatic mode, the pump begins to operate when the reservoir air pressure drops to a preselected minimum, and stops pumping when the reservoir air pressure reaches a preselected maximum level. Automatic of the electric pump is provided by a pressure-activated automatic control switch that switches the electric pump on and off in response to pressure changes in the reservoir bag. In this way, the electric pump may be utilized as either a back-up to the manual pump, or it may be used to replace the manual pump. This greatly improves the safety of the device, as well as freeing the pump operator to perform other tasks when desired. With the use of an electric pump in automatic mode, the entire device may conveniently be operated by a single person.

Based on the foregoing, a number of advantages of the present invention are readily apparent. A unique underwater breathing apparatus is provided which requires no special training and which utilizes simple, low cost equipment. The apparatus is also very lightweight, and the reservoir bag is collapsible, allowing for great portability and ease of storage. Since there are no complicated pumps, regulators, or high pressure tanks to fail, the risk of operating the apparatus is greatly reduced. In addition, the use of the reservoir bag provides a margin of safety not found with previous inventions. Additional safety and convenience may be provided by the use of an electric pump, either as the replacement for the manual pump or as a back-up thereto. The same advantages are realized when the intermediate bag is used in conjunction with the reservoir bag. Additional advantages of the intermediate bag are:

1) safety: allows people on boats, docks, etc., to know the location of the diver;
2) safety: prevents diver from submerging below a depth determined by the length of air hose from the intermediate bag to the diver's mouthpiece;
3) efficiency: greatly reduces the loss of breathable air through the exhaust valve in the diver's mouthpiece; and
4) convenience: permits more direct routing of air lines to the diver.

Additional advantages of this invention will become readily apparent from the description which follows, together with the accompanying drawings.

DESCRIPTION OF PREFERRED EMBODIMENTS

Figure 1:
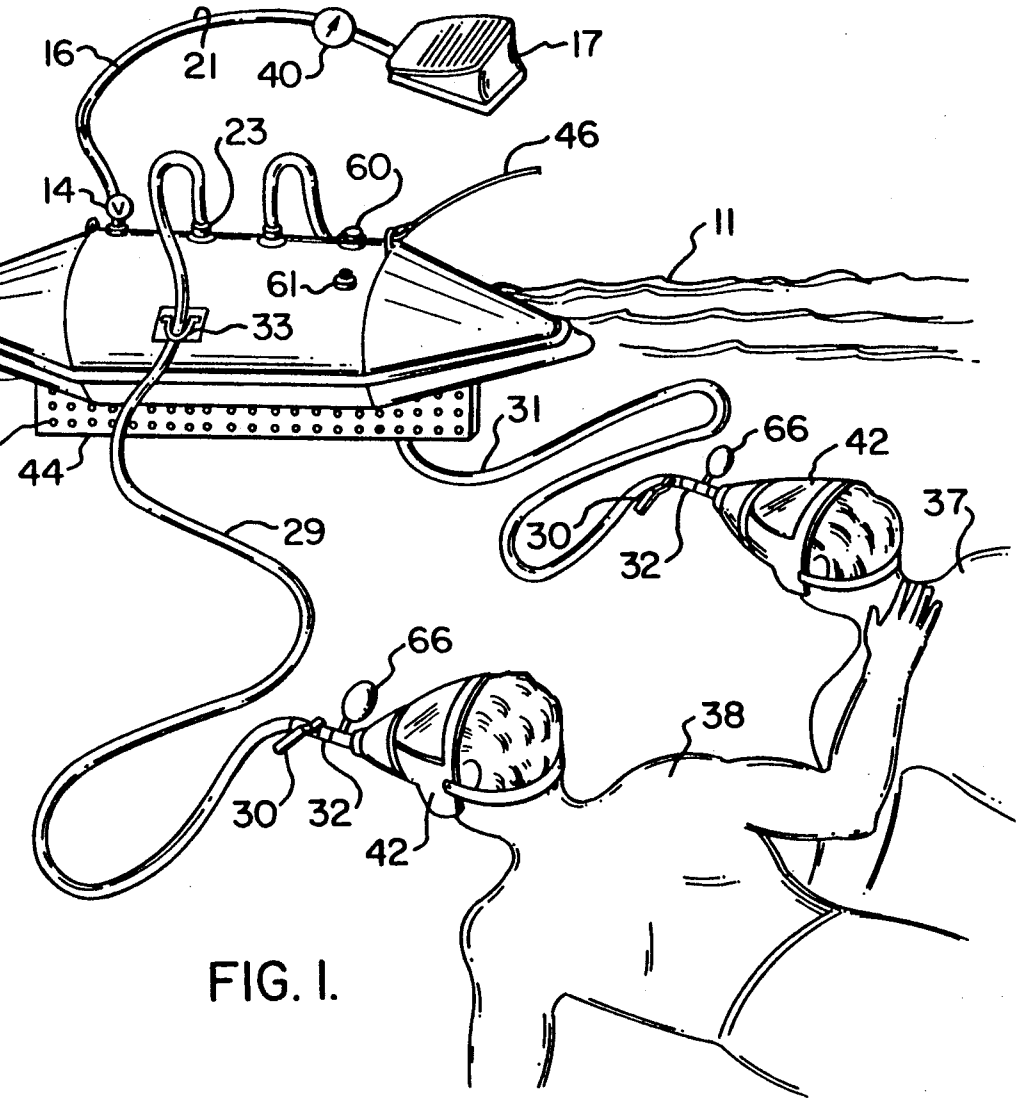
FIG. 1 is a perspective view of the underwater breathing apparatus of the present invention showing the reservoir bag delivering air to two divers. The breathing means used by the divers is a full face mask.
Figure 2:
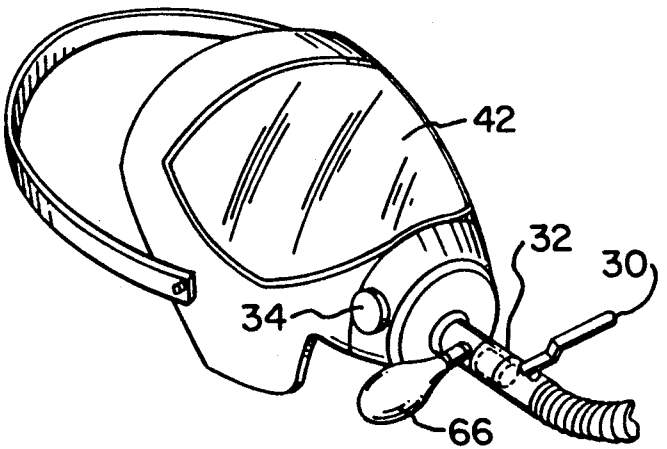
FIG. 2 is a front view of the full face mask and a portion of the air hose, showing the one-way inlet valve, one-way exhaust valve, as well as the flow restrictor/shut off valve.

Referring now to FIGS. 1 and 2, there is shown an underwater breathing apparatus (10) including a pump (17), reservoir bag (12), and a full face mask (42). The reservoir bag (12) is designed to float on the surface of a body of water (11). Ideally, the reservoir bag (12) is an inflatable bag constructed of light, flexible, air-tight material such as polyurethane. Although a heavier rigid reservoir bag could be utilized, a light-weight inflatable bag will collapse when deflated to provide greater portability and to require far less storage space. Although the reservoir bag (12) is designed to be floatable on water, it could easily be adapted for use on a dry surface, such as on a boat, poolside or dockside. The reservoir bag (12) has a one-way inlet valve (14) for receiving pressurized air (16) from a manual pump (17). Preferably, the manual pump (17) is a foot-powered bellows pump, although other types of manual pumps might be used for this purpose. The manual pump (17) delivers pressurized air (16) through inlet hose (21) to the reservoir bag (12) via a one-way inlet valve (14). Air hoses (29, 31) are provided for delivery of air to the divers (37, 38), although a greater or lesser number may be employed depending on the anticipated number of divers to be using the apparatus. Optional hose clamps (33) are provided to secure the hoses to the reservoir bag (12), thereby minimizing motion of the air hoses (29, 31) during operation. Each diver wears a full face mask (42) having an optional one-way inlet valve (32) for receiving air and a one-way exhaust valve (34) for exhaling air. The one-way inlet valve (32) may be dispensed with if desired, as air reservoir pressure will typically cause air to flow through the air hoses (29, 31) at a steady rate, and excess air will readily be exhausted from the full face mask (42) through a one-way exhaust valve (34). As an alternative to the use of a full face mask, divers could easily use other comparable arrangements such as the mouthpiece apparatus (such as shown in FIG. 4 and described below) coupled with a conventional face mask.

The reservoir bag (12) will preferably have an elongated ellipsoid shape to allow for smooth movement through the water. Optimal sizes for the reservoir bag (12) have been determined to be approximately 5 feet long by 2 feet in diameter for two divers (approximately 9 cubic feet), and approximately 3 feet long by 1 and ½ feet in diameter for one diver (approximately 3.5 cubic feet). It is also important to minimize tipping of the reservoir bag (12) in wind or rough water, in order to avoid tangled lines and other potential problems. In order to minimize tipping of the reservoir bag (12), ballast (43) may be provided at the bottom of the reservoir bag (12) along the bag's lengthwise center. As shown in FIG. 1, the effectiveness of the ballast (43) may be optimized by incorporating the ballast into a fin (44) extending lengthwise along the bottom of the reservoir bag (12). The fin (44) also helps to reduce tipping, as well as to stabilize the motion of the reservoir bag (12) through the water. To aid further in stabilizing the bag against tipping, an annular ring (45) of buoyant material may also be provided to encircle the reservoir bag (12) at approximately the water level. A tether line (46) is useful to attach the apparatus (10) to a dock, boat, or the like.

Figure 3:
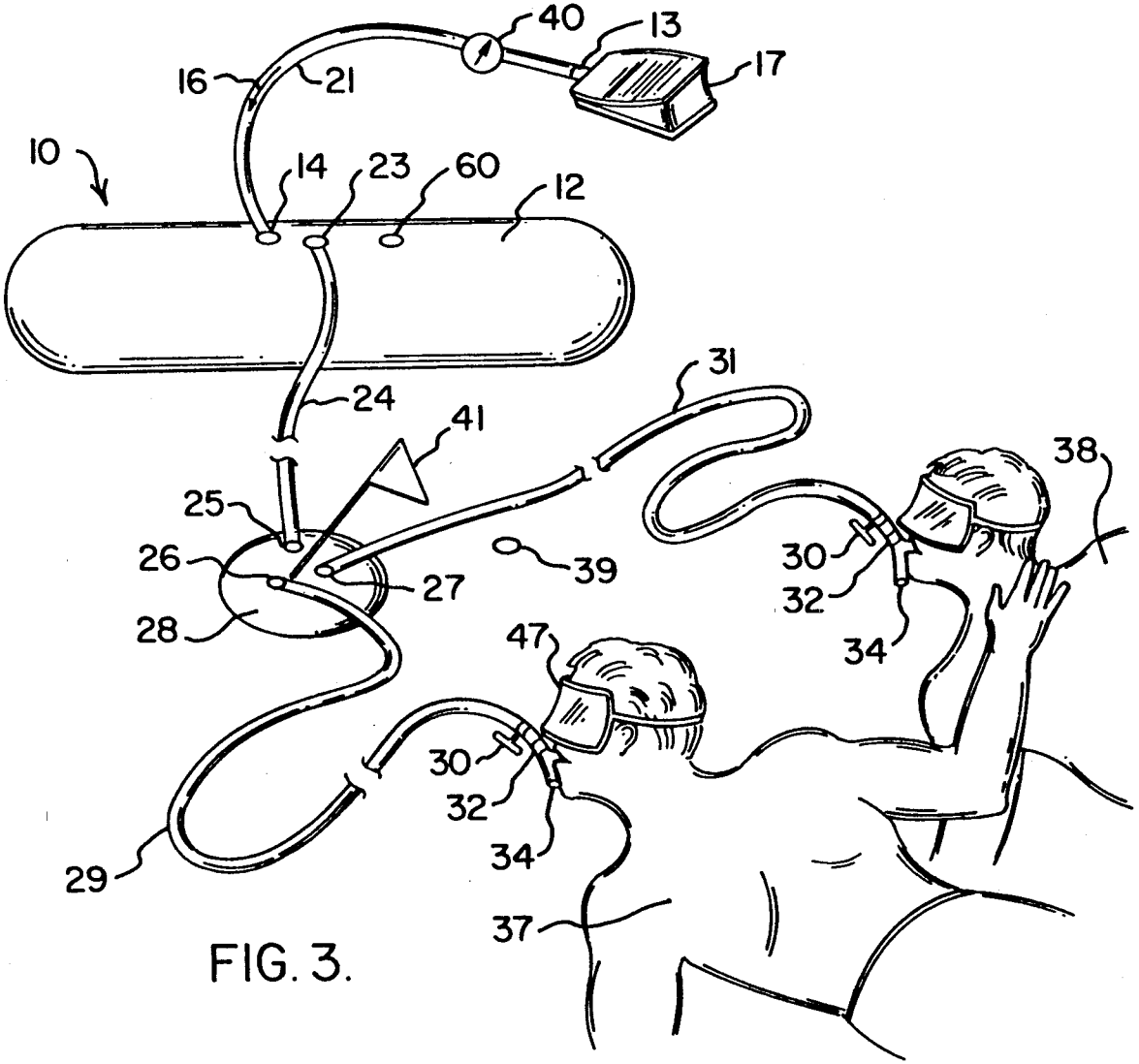
FIG. 3 is a perspective view of the underwater breathing apparatus of the present invention showing the reservoir bag and the intermediate bag delivering air to two divers. The breathing means used by the divers is a mouthpiece apparatus. Also shown is a conventional face mask.
Figure 4:
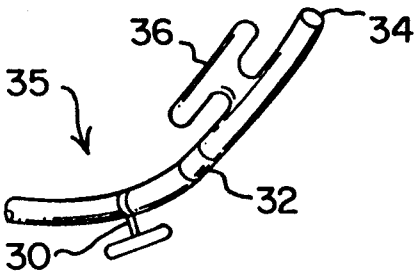
FIG. 4 is an illustration of the mouthpiece apparatus, showing a flow restrictor/shut-off valve and a portion of the air hose. Also shown are the one-way inlet valve, one-way exhaust valve and mouthpiece.

In an alternative embodiment, referring now to FIGS. 3 and 4, there is shown an underwater breathing apparatus (10) including a manual pump (17), the reservoir bag (12), intermediate bag (28), and mouthpiece apparatus (35). Although both bags are designed to be floatable on water, in this embodiment the reservoir bag is normally used on a dry surface such as a boat deck, whereas the intermediate bag normally floats on the water. The reservoir bag in FIG. 3 does not show the features useful in minimizing tipping, such as ballast (43), a fin (44), and an annular ring (45). However, these adaptations could be made if it was desired to use the reservoir bag (12) in the water. As in the first embodiment, the reservoir bag (12) utilizes a one-way inlet valve (14) for receiving pressurized air (16) from a manual pump (17), such as a foot-powered bellows pump or other type of manual pump. The pump (17) delivers pressurized air (16) through inlet hose (21) to the reservoir bag (12) via a unidirectional inlet valve (13). An air hose (24), which receives air from outlet (23), is provided for delivery of pressurized air to the intermediate bag (28) via an inlet (25). Ideally, the reservoir bags and the intermediate bags are inflatable and constructed of light, flexible, air-tight material such as polyurethane. Although heavier, rigid reservoir bags and intermediate bags could be utilized, light-weight inflatable reservoir bags and intermediate bags will collapse when deflated to provide greater portability and require far less storage space. A flag (41), or other type of signaling device, can be attached to the intermediate bag (28) to allow people on the surface of the water to know the approximate location of the diver. Air hoses (29 and 31) are provided for delivery of pressurized air to the divers (37 and 38), although a greater or lesser number of air hoses may be employed depending on the anticipated number of divers to be using the apparatus. For best results, each diver wears the mouthpiece apparatus (35) having a flow restrictor/shut off valve (30), one-way inlet valve (32) for receiving air, one-way exhaust valve (34) for exhaling air and a mouthpiece (36). A conventional face mask (47) (i.e., one that covers the eyes and nose) is worn by the diver when the mouthpiece apparatus is used. As an alternative to the use of the mouthpiece apparatus, divers could easily use other comparable arrangements such as a full face mask (discussed above and shown in FIG. 2).

When the reservoir bag and intermediate bag are used together, as in this embodiment, it has been determined that the optimal size of the reservoir bag (12) is approximately 3.5 cubic feet and the optimal size for the intermediate bag (28) is approximately 1 cubic foot. It would be understood to one of ordinary skill in the art that a range of sizes may be employed for the reservoir bags (12 and 28), depending on the number of divers using the apparatus. As a general guideline, for each additional diver, 0.3 additional cubic feet are needed for both the reservoir bag and intermediate bag.

Regardless of whether the reservoir bag is used alone or in conjunction with the intermediate bag, air pressure in the reservoir bag (12) must be maintained within a desired range based on the depth to which the divers will descend. Air pressure must at least be high enough to force a positive flow of air to the required depth, yet not so high as to create an excessive flow of air to the diver. For most applications, the desired diving depth will range from 4 to 10 feet, with the corresponding minimum air pressure range being approximately 2 to 5 psi gauge (all pressures cited herein are gauge pressures). The minimum air pressure required for a positive air flow for a selected depth of a diver's descent may be calculated from the well-known linear relationship of water depth to pressure. At approximately 34 feet of diving depth (or 33 feet of salt water), there exists an additional one atmosphere or 14.7 psi of pressure. This means that at any air reservoir pressure greater than 14.7 psi, a positive air flow would be established to a diver at a depth of 34 feet. Since the relationship is linear, it may be seen that for each foot of diving depth, approximately 0.43 additional psi of air reservoir pressure is required to maintain a positive air flow to the diver. Thus, a diving depth of 4 feet will require approximately 1.72 psi of air pressure in the reservoir bag (12), an 8 foot diving depth will require approximately 3.44 psi, and so on. It should be noted that for practical purposes, and within the depth range of the apparatus, the pressure can be rounded off to the nearest 0.1. Tests have shown that it would be bellows-type pump delivering 3–4 liters of air per pump stroke to maintain sufficient air pressure for a diver operating below about 10 to 12 feet beneath the surface. Of course, the difficulty of pumping will vary with the pump operator.

In order to monitor air pressure in the reservoir bag (12), a pressure gauge (40) is provided in a position where it can be easily read by the pump operator, such as on bag inlet hose (21) near the pump (17). The pump operator may then maintain the air pressure in the bag within a desired range by selectively operating the pump (17).

As an example, When the reservoir bag (12) is used alone, as in the first embodiment, to maintain pressure within a range of 2 psi to 6 psi, the pump operator would typically operate the pump until the air pressure in the bag reached 6 psi. The operator would then cease pumping until the air pressure dropped to 2 psi, and would then resume pumping. Extrapolation from test results have shown that for two average divers performing moderate activity at a depth of 8 feet and using a 9 cubic foot bag, a pump having a capacity of 3–4 liters per cycle would need to be pumped approximately seventeen times every minute to maintain air pressure within the range of 2 psi to 6 psi. With continuous pumping, ten pump strokes may easily be accomplished in 20 seconds or less. Calculations based on test results show that the reservoir pressure will drop from 6 psi to 1 psi in about 60 seconds without pumping, and that approximately 40 seconds of pumping are needed to bring the bag pressure back up to 6 psi.

In another example, when the reservoir bag is used in conjunction with the intermediate bag, the pressure should be maintained within a range of about 2.6 psi to 3 psi for a diver at a maximum depth of 6.5 feet. The pump operator would typically operate the pump until the air pressure in the reservoir bag reaches about 3 psi. The operator would then cease pumping until the air pressure dropped to about 2.6 psi, and would then resume pumping. Extrapolations from test results have shown that a diver performing moderate activity at a depth of 6.5 feet, using a 3.5 cubic foot reservoir bag, and a pump with a capacity of 3–4 liters per cycle, would need to be pumped approximately seven to ten times every minute to maintain air pressure within the range of about 2.6 psi to 3.0 psi. With continuous pumping, ten pump strokes may easily be accomplished in twenty seconds or less. Tests under the same conditions using both the reservoir bag and intermediate bag show that the pressure in the reservoir bag will drop from 3 psi to 2.6 psi in about 12 seconds without pumping, and that approximately 2 seconds of pumping are needed to bring the pressure back up to 3 psi. From these data, it can be seen that the pump operator has a considerable amount of free time to devote to activities other than pumping. For a single diver at 6.5 feet, a single reservoir system requires approximately 10 pumps/minute, whereas the reservoir bag plus the intermediate bag requires approximately 7–8 pumps/minute using a 4 liter/stroke pump. Thus, as can be seen by these examples, the use of the reservoir bag (12) in conjunction with the intermediate bag (28), in contrast to using the reservoir bag alone, decreases the amount of time spent maintaining the pressure.

Figure 5:
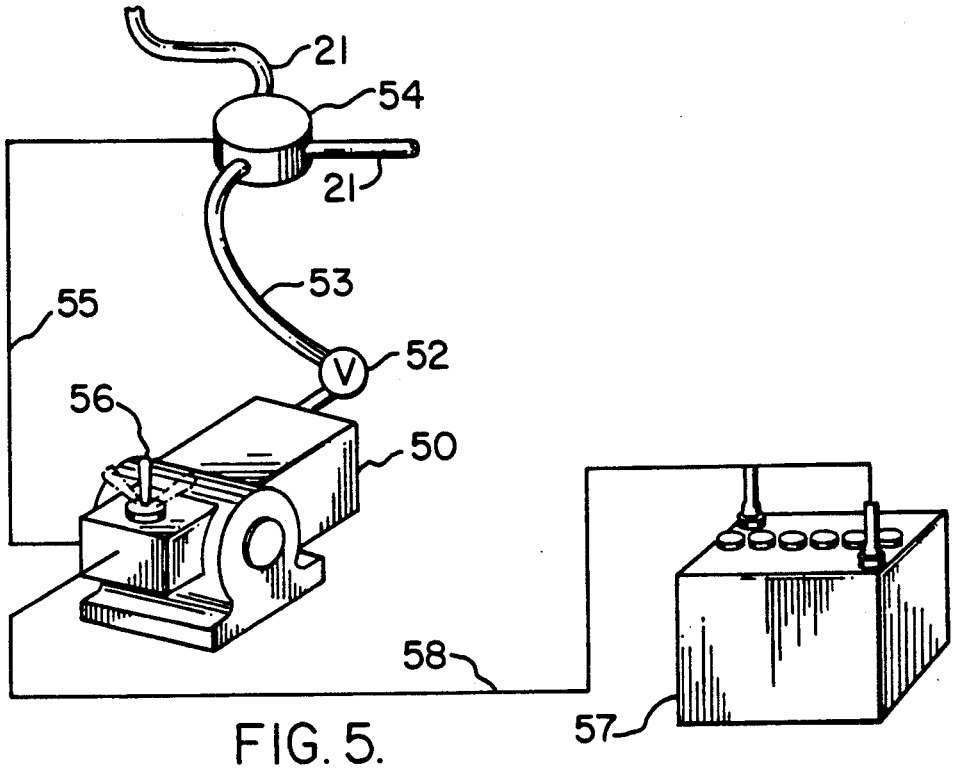
FIG. 5 is a plan view showing the electrical pump and the transducer.
Figure 6:
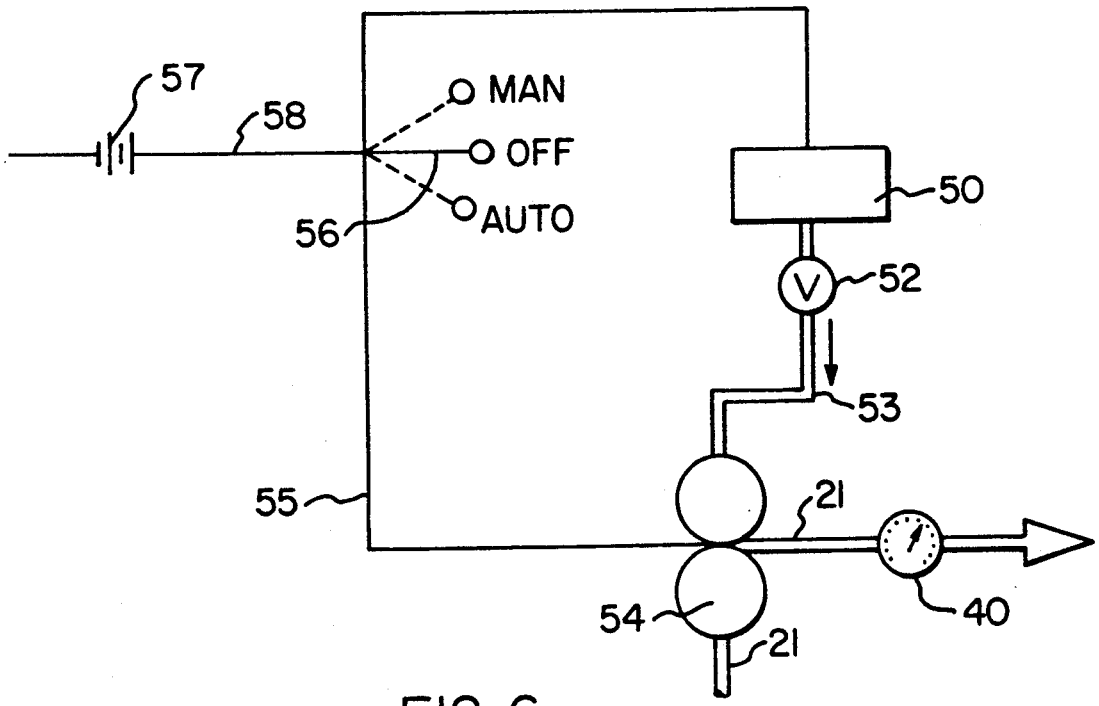
FIG. 6 is a schematic view depicting the cooperation of the electric pump, the transducer, and the three-way master switch.

In another embodiment of the present invention, as depicted in FIGS. 5 and 6, an electric pump (50) is provided for alternate use with the manual pump (17). To avoid contamination of the pumped air, an oil-less pump will give the best results. The electric pump (50) also has a one-way exhaust valve (52) connected via air hose (53) to bag inlet hose (21) for delivering air to the reservoir bag (12). A pressure-sensitive automatic control switch (54), is provided on inlet hose (21) at its juncture with air hose (53). The pressure-sensitive automatic control switch (54) is electrically connected to the electric pump (50) by electrical line (55), and can be set to automatically activate the pump when the pressure in the reservoir bag falls to a selected minimum level, such as 2 psi, and to shut the pump off when pressure reaches a maximum level, such as 6 psi. A three-way master switch (56) allows the electric pump to be locked into an "on" position, an "off" position, or to be set for automatic operation as previously described. A power supply (57), such as a common car battery, is connected to the electric pump (50) via electrical line (58) and provides the electricity to operate the system.

From this discussion it may be seen that the electric pump may be used as a backup to the manual pump for safety or convenience purposes, or may alternatively be used for extended periods as a complete replacement for the manual pump. Using the electric pump to automatically perform the functions of the manual pump has the advantage of freeing the pump operator to perform other tasks. In fact, with an electric pump operating automatically, a diver may easily operate the device without assistance and thereby dive alone. However, for safety reasons, diving alone is not recommended.

One or more pressure release valves (60, 61) will operate to release air from the reservoir bag (12) at or above a predetermined maximum pressure level to prevent damage from overpressuring the system. Generally, this maximum pressure level will coincide with or slightly exceed the maximum desired bag pressure level for the estimated maximum diver depth, as discussed above. For example, a 4 psi release valve might be used. Alternately, an adjustable pressure release valve to release air from the bag at or above a predetermined maximum pressure level might be used.

In addition, to maintain a sufficient amount of air for the divers to breath at various depths without allowing an excessive loss of air, an adjustable flow restrictor/shut-off valve (30) is provided. For example, if the divers decrease their depth, it may be necessary to adjust the flow restrictor/shut-off valve to reduce the air flow. Further, to prevent loss of air pressure when the reservoir bag (12) is pressurized but not in use, or when less than the maximum number of divers are using the apparatus, a restrictor/shut-off valve (30) is provided on each of the air hoses (29 and 31). For example, when the restrictor/shut-off valve (30) is in the "off" position, as when a single diver (37) is diving from a two-diver device (10), no air may escape through the unused line (31). Additionally, this allows the unused line (31) to be removed or simply to be coiled out of the way so as not to interfere with the diver's operations. During a temporary break in diving operations, both restrictor/shut-off valves (30) are moved to the "off" position to better maintain pressure in the reservoir bag (12). Having the divers shut off air flow using the restrictor/shut-off valves (30) will be convenient, since the divers will always be close to the restrictor/shut-off valves (30) during diving operations and will generally know most precisely when diving operations are ready to cease.

Additionally, a one-way manual squeeze pump (66) may be provided on the breathing means to serve a dual purpose. In one use, the manual squeeze pump (66) operates to purge water from the diver's line (29, 31). The manual squeeze pump (66) may also be used to temporarily pump air through the line to the diver in the event that the diver mistakenly descends to a depth at which the air reservoir pressure is insufficient to supply air to the diver. Although shown on the full face mask (FIGS. 1 and 2), the manual squeeze pump (66) could also be used with the mouthpiece apparatus.

Further, when only one diver is using the apparatus, an outlet may be capped by using outlet cap (39) to cap either outlet (26) or (27) (FIG. 3).

This invention has been described in detail with reference to particular embodiments thereof, but it will be understood that various other modifications can be effected within the spirit and scope of this invention.

PARTS LIST

10: Apparatus, generally
11: Water Surface
12: Reservoir Bag
13: Unidirectional Inlet Valve
14: One-Way Inlet Valve (Bag)
16: Pressurized Air
17: Manual Pump
21: Inlet Hose to the Reservoir Bag
23: Outlet (Reservoir Bag)
24: Air Hose to Intermediate Bag
25: Inlet Intermediate Bag
26–27: Outlet Intermediate Bag
28: Intermediate Bag
29, 31: Air Hose to Diver
30: Flow Restrictor/Shut Off Valve
32: One-Way Inlet Valve (Breathing Means)
33: Hose Clamp
34: One-Way Exhaust Valve (Breathing Means)
35: Mouthpiece Apparatus
36: Mouthpiece
37–38: Diver
39: Outlet Cap for Intermediate Bag
40: Pressure Gauge
41: Flag
42: Full Face Mask
43: Ballast
44: Fin
45: Annular Ring
46: Tether Line
47: Conventional Face Mask
50: Electric Pump
52: One-Way Exhaust Valve (Pump)
53: Air Hose (Electric Pump)
54: Pressure-Sensitive Automatic Control Switch
55: Electrical Line
56: Three-Way Master Switch
57: Power Supply
58: Electrical Line (Power Supply)
60, 61: Pressure Release Valve
66: One-way Manual Squeeze Pump

We claim:

1. An underwater breathing apparatus for supplying air to a submerged diver, comprising:

a) a first reservoir bag at or above the surface of the water having an inlet and an outlet capable of maintaining a plurality of gauge pressures from about 1.7 psi up to about 6 psi;

b) a floatable variable-pressure second reservoir bag having an inlet and an outlet, said floatable variable-pressure reservoir bag connected by means of an air hose to said first reservoir bag whereby pressure is supplied to said second bag from said first reservoir bag;

c) breathing means worn by said diver for receiving air from said reservoir bag;

d) an air hose for delivering air from said second bag to said diver, said hose being connected at one end to said second bag outlet and at the other end to said diver breathing means;

e) pump means connected to said first reservoir bag inlet via an air hose for delivering air under pressure to said first reservoir bag whereby a gauge pressure between about 1.7 and about 6 psi may be maintained in said first reservoir bag; and f) means for maintaining the air pressure in said first reservoir bag within a selected range.

2. An underwater breathing apparatus as claimed in claim 1, wherein said pump means is a manually operated pump and said means for maintaining air pressure includes a pressure gauge for gauging pressure in said first reservoir bag to allow said pump to be selectively operated in response to pressure variations within said first reservoir bag.

3. An underwater breathing apparatus as claimed in claim 1, wherein said first reservoir bag has a pressure relief valve for preventing damage from excessive pressure.

4. An underwater breathing apparatus as claimed in claim 1, further including a one-way manual squeeze pump on said air hose near said diver for manually forcing air from said hose toward said diver.

5. An underwater breathing apparatus as claimed in claim 1, wherein said pump means is a motor-driven pump and said means for maintaining air pressure includes pressure-sensitive means for automatically operating said pump in response to pressure variations in said first reservoir bag.

6. An underwater breathing apparatus as claimed in claim 5, further including:

a) a motor-driven pump connected to said first reservoir bag inlet; and b) pressure-sensitive means for automatically operating said motor driven pump as an alternative to said manual pump in response to variations in reservoir air pressure.

7. An underwater breathing apparatus as claimed in claim 1, wherein said breathing means includes a face mask having a one-way exhaust valve for exhaling air.

8. An underwater breathing apparatus as claimed in claim 7, wherein said face mask includes a one-way valve for inhaling air.

9. An underwater breathing apparatus as claimed in claim 7, wherein said face mask includes a manually operated flow restrictor/shut-off valve for controlling air flow to said diver.

10. An underwater breathing apparatus as claimed in claim 1, wherein said breathing means includes a mouthpiece apparatus having a one-way exhaust valve for exhaling air.

11. An underwater breathing apparatus as claimed in claim 10, wherein said mouthpiece apparatus includes a one-way valve for inhaling air.

12. An underwater breathing apparatus as claimed in claim 10, wherein said mouthpiece apparatus includes a manually operated flow restrictor/shut-off valve for controlling air flow to said diver.

13. An underwater breathing apparatus for supplying air to a submerged diver, comprising:

a) a first reservoir bag used at or above the surface of the water having an inlet and an outlet capable of maintaining a plurality of gauge pressures suitable to provide breathable air to a diver at a depth from about 4 feet up to about 12 feet;

b) a floatable variable-pressure second reservoir bag having an inlet and an outlet;

c) an air hose for delivering pressurized air from said first reservoir bag to said floatable variable-pressure second reservoir bag, said hose being connected at one end to said first reservoir bag outlet and at the other end to said floatable variable-pressure second reservoir bag inlet;

d) a manually operated pump connected to said first reservoir bag inlet via an air hose for delivering air under pressure to said first reservoir bag;

e) a pressure gauge for measuring the air pressure in said first reservoir bag to allow the pump to be selectively operated in response to bag pressure variations in order to maintain said air pressure within a selected range;

f) a breathing means worn by said diver for receiving air from said floatable variable-pressure second reservoir bag;

g) an air hose for delivering air from said floatable variable-pressure second reservoir bag to said diver, said hose being connected at one end to said floatable variable-pressure second reservoir bag outlet and at the other end to said diver breathing means; and h) a pressure release means on said first reservoir bag, said means being activated at selected bag pressure levels to relieve air pressure in said first reservoir bag above said pressure levels.

14. An underwater breathing apparatus as claimed in claim 13, further including a one-way manual squeeze pump on said air hose near said diver for manually forcing air from said hose toward said diver.

15. An underwater breathing apparatus as claimed in claim 13, further including a buoyant annular ring encircling said first reservoir bag at or near water level, and ballast along the bottom of said first reservoir bag, said annular ring and said ballast assisting in maintaining said first reservoir bag in an upright position in the water.

16. An underwater breathing apparatus for supplying air to a submerged diver, comprising:

a) a floating first reservoir bag having an inlet and an outlet capable of maintaining a plurality of gauge pressures from about 1.7 psi up to about 6 psi;

b) a floatable variable-pressure second reservoir bag having an inlet and an outlet;

c) an air hose for delivering pressurized air from said first reservoir bag to said floatable variable-pressure second reservoir bag, said hose being connected at one end to said first reservoir bag outlet and at the other end to said floatable variable-pressure second reservoir bag inlet;

d) a manually operated pump connected to said first reservoir bag inlet via an air hose for delivering air under pressure to said first reservoir bag;

e) a pressure gauge for measuring the air pressure in said first reservoir bag to allow the pump to be selectively operated in response to bag pressure variations in order to maintain said air pressure within a selected range;

f) a breathing means worn by said diver for receiving air from said floatable variable-pressure second reservoir bag.

17. An underwater breathing apparatus for supplying air to a submerged diver, comprising:

a) a first reservoir bag used on a dry surface having an inlet and an outlet capable of maintaining a plurality of gauge pressures from about 1.7 psi up to about 6 psi;

b) a floatable variable-pressure second reservoir bag having an inlet and an outlet;

c) an air hose for delivering pressurized air from said first reservoir bag to said floatable variable-pressure second reservoir bag, said hose being connected at one end to said first reservoir bag outlet and at the other end to said floatable variable-pressure second reservoir bag inlet;

d) a manually operated pump connected to said first reservoir bag inlet via an air hose for delivering air under pressure to said first reservoir bag;

e) a pressure gauge for measuring the air pressure in said first reservoir bag to allow the pump to be selectively operated in response to bag pressure variations in order to maintain said air pressure within a selected range;

f) a breathing means worn by said diver for receiving air from said floatable variable-pressure second reservoir bag.

18. An underwater breathing apparatus for supplying air to a submerged diver, comprising:

a) a reservoir bag at or above the surface of the water having an inlet and an outlet capable of maintaining a plurality of gauge pressures up to about 6 psi;

b) breathing means worn by said diver for receiving air from said reservoir bag;

c) an air hose for delivering air from said reservoir bag to said diver, said hose being connected at one end to said pressurized reservoir bag outlet and at the other end to said diver breathing means;

d) motor-driven pump means connected to said reservoir bag inlet via an air hose for delivering air under pressure to said pressurized reservoir bag whereby a pressure between about 1.7 and about 6 psi may be maintained in said reservoir bag; and e) means connected to said pump means for maintaining the air pressure in said reservoir bag within a selected range and automatically operating said pump means in response to pressure variations in said reservoir bag.

19. An underwater breathing apparatus for supplying air to a submerged diver comprising:

a) a pressurized reservoir bag at or above the surface of the water having an inlet and an outlet capable of maintaining a plurality of gauge pressures up to about 6 psi;

b) breathing means worn by said diver for receiving air from said reservoir bag;

c) an air hose for delivering air from said reservoir bag to said diver, said hose being connected at one end to said pressurized reservoir bag outlet and at the other end to said diver breathing means;

d) manually-operated pump means connected to said reservoir bag inlet via an air hose for delivering air under pressure to said pressurized reservoir bag whereby a pressure between about 1.7 and about 6 psi may be maintained in said reservoir bag;

e) a motor-driven pump connected to said pressurized reservoir bag inlet;

f) pressure sensitive means connected to said motor-driven pump for automatically operating said motor-driven pump as an alternative to said manual pump in response to variations in reservoir air pressure.

20. An underwater breathing apparatus for supplying air to a submerged diver, comprising:

a) a reservoir bag at or above the surface of the water having an inlet and an outlet capable of maintaining a plurality of gauge pressures suitable to provide breathable air to a diver at a depth of from about 4 feet up to about 12 feet;

b) breathing means worn by said diver for receiving air form said reservoir bag;

c) an air hose for delivering air from said reservoir bag to the diver, said hose connected at one end to said reservoir bag outlet and at the other end to said diver breathing means;

d) a manually operated pump connected to said reservoir bag inlet via an air hose for delivering air under pressure to said reservoir bag;

e) a pressure gauge for measuring the air pressure in said reservoir bag to allow the pump to be selectively operated in response to bag pressure variations in order to maintain said air pressure within a selected range;

f) pressure release means on said reservoir bag, said means being activated at selected bag pressure levels to relieve air pressure in said reservoir bag above said pressure levels; and g) a one-way manual squeeze pump on said air hose near said diver for manually forcing air from said hose toward said diver.

* * * * *